US010180059B2

(12) United States Patent
Lee et al.

(10) Patent No.: US 10,180,059 B2
(45) Date of Patent: Jan. 15, 2019

(54) TELEMETRY TOOL WITH A FLUID PRESSURE PULSE GENERATOR

(71) Applicant: Evolution Engineering Inc., Calgary, Alberta (CA)

(72) Inventors: Gavin Gaw-Wae Lee, Calgary (CA); Aaron W. Logan, Calgary (CA); Kurtis West, Calgary (CA); Justin C. Logan, Calgary (CA)

(73) Assignee: EVOLUTION ENGINEERING INC., Calgary, Alberta (CA)

( * ) Notice: Subject to any disclaimer, the term of this patent is extended or adjusted under 35 U.S.C. 154(b) by 0 days.

(21) Appl. No.: 15/385,658

(22) Filed: Dec. 20, 2016

(65) Prior Publication Data

US 2018/0171785 A1 Jun. 21, 2018

(51) Int. Cl.
*E21B 47/18* (2012.01)

(52) U.S. Cl.
CPC ..... *E21B 47/185* (2013.01)

(58) Field of Classification Search
CPC ..... E21B 47/18; E21B 47/185; E21B 47/187
USPC ..... 367/83, 84
See application file for complete search history.

(56) References Cited

U.S. PATENT DOCUMENTS 3,739,331 A 6/1973 Godbey et al.
4,699,352 A 10/1987 Mumby
4,785,300 A 11/1988 Chin
4,876,672 A 10/1989 Petermann
4,914,637 A 4/1990 Goodsman
5,357,483 A 10/1994 Innes
5,586,083 A 12/1996 Chin et al.
(Continued)

FOREIGN PATENT DOCUMENTS

CA 1228909 11/1987
CA 1268052 4/1990
(Continued)

OTHER PUBLICATIONS

PCT/CA2013/051006 International Search Report & Written Opinion dated Mar. 24, 2014.
(Continued)

*Primary Examiner* — Albert K Wong
(74) *Attorney, Agent, or Firm* — Jeffer Mangels; Butler & Mitchell LLP; Brennan C. Swain, Esq.

(57) ABSTRACT

A telemetry tool comprising a pulser assembly, a primary seal, a fluid pressure pulse generator and a secondary seal. The pulser assembly comprises a housing and a driveshaft extending out of an opening in the housing. The primary seal surrounds and seals against the driveshaft to seal the opening in the housing. The fluid pressure pulse generator comprises a stator with a bore therethrough configured to fixedly attach to the housing or to a drill collar surrounding the fluid pressure pulse generator, and a rotor fixedly attached to the driveshaft. The driveshaft and rotor rotate relative to the fixed stator to generate pressure pulses in mud flowing through the fluid pressure pulse generator. The secondary seal is seated in the stator bore and surrounds and seals against a portion of the driveshaft extended out of the housing or a portion of the rotor to reduce the amount of mud, grit and debris impinging on the primary seal which could otherwise cause wear or damage the primary seal.

21 Claims, 12 Drawing Sheets

(56) References Cited

U.S. PATENT DOCUMENTS

| | | | | |
|---|---|---|---|---|
| 5,636,178 | A | 6/1997 | Ritter | |
| 5,740,126 | A | 4/1998 | Chin et al. | |
| 6,050,349 | A * | 4/2000 | Rountree | E21B 4/02 175/40 |
| 6,714,138 | B1 * | 3/2004 | Turner | E21B 47/18 340/854.3 |
| 6,970,398 | B2 | 11/2005 | Lavrut et al. | |
| 7,083,008 | B2 | 8/2006 | Thorp et al. | |
| 7,133,325 | B2 | 11/2006 | Ketsonis et al. | |
| 7,230,880 | B2 | 6/2007 | Lehr | |
| 7,468,679 | B2 * | 12/2008 | Feluch | E21B 47/187 175/40 |
| 7,564,741 | B2 | 7/2009 | Pratt et al. | |
| 8,020,632 | B2 | 9/2011 | Moriarty | |
| 8,138,943 | B2 | 3/2012 | Kusko et al. | |
| 8,151,905 | B2 | 4/2012 | Song | |
| 8,164,477 | B2 | 4/2012 | Li | |
| 8,181,719 | B2 | 5/2012 | Bunney et al. | |
| 8,203,908 | B2 | 6/2012 | Pratt et al. | |
| 8,739,897 | B2 | 6/2014 | Thorp | |
| 9,528,370 | B2 | 12/2016 | Logan et al. | |
| 2005/0199423 | A1 | 9/2005 | Moriarty | |
| 2005/0231383 | A1 | 10/2005 | Pratt et al. | |
| 2007/0008377 | A1 | 1/2007 | Jia et al. | |
| 2009/0133930 | A1 | 5/2009 | Thorp et al. | |
| 2009/0266544 | A1 | 10/2009 | Redlinger et al. | |
| 2010/0039287 | A1 | 2/2010 | Li | |
| 2011/0280105 | A1 | 11/2011 | Hall et al. | |
| 2012/0127829 | A1 | 5/2012 | Sitka | |
| 2013/0048300 | A1 | 2/2013 | MacDonald | |
| 2013/0051177 | A1 | 2/2013 | Vecseri | |
| 2014/0028293 | A1 | 1/2014 | Johnson et al. | |
| 2017/0138186 | A1 | 5/2017 | Lee et al. | |

FOREIGN PATENT DOCUMENTS

| | | |
|---|---|---|
| CA | 1299998 | 5/1992 |
| CA | 2174017 | 10/1996 |
| CA | 2098676 | 11/1997 |
| CA | 2551316 | 12/2007 |
| CA | 2528999 | 9/2009 |
| CA | 2506912 | 7/2013 |
| CA | 2855930 | 5/2014 |
| CN | 203271731 | 11/2013 |
| CN | 203452776 | 2/2014 |
| CN | 103410503 | 6/2016 |
| GB | 2156915 | 10/1985 |
| GB | 2271790 | 2/1996 |
| GB | 2411676 | 9/2005 |
| GB | 2443096 | 10/2008 |
| WO | 2005084281 | 9/2005 |
| WO | 2006130606 | 12/2006 |
| WO | 2010138961 | 12/2010 |
| WO | 2012130936 | 10/2012 |
| WO | 2012145637 | 10/2012 |
| WO | 2014071514 | 5/2014 |

OTHER PUBLICATIONS

PCT/CA2015/050587 International Search Report & Written Opinion dated Sep. 18, 2015.

PCT/CA2015/050586 International Search Report & Written Opinion dated Sep. 23, 2015.

PCT/CA2015/050576 International Search Report & Written Opinion dated Sep. 22, 2015.

PCT/CA2016/051298 International Search Report & Written Opinion dated Jan. 17, 2017.

EP13866031.1 Search Reports dated Feb. 22, 2016 and Jul. 19, 2016.

EP15177783.6 Search Reports dated Feb. 22, 2016 and Jul. 18, 2016.

EP15177784.4 Search Reports dated Feb. 22, 2016 and Jul. 18, 2016.

Office Action dated Feb. 23, 2018 in Canada Appln. 2,952,229.

* cited by examiner

TELEMETRY TOOL WITH A FLUID PRESSURE PULSE GENERATOR

FIELD OF THE INVENTION

This disclosure relates generally to a telemetry tool with a fluid pressure pulse generator, such as a mud pulse telemetry measurement-while-drilling ("MWD") tool.

BACKGROUND OF THE INVENTION

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which generally comprises: 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole MWD telemetry known as mud pulse telemetry involves creating pressure waves ("pulses") in the drilling mud circulating through the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Pulse frequency is typically governed by pulse generator motor speed changes. The pulse generator motor requires electrical connectivity with the other elements of the MWD probe.

One type of valve mechanism used to create mud pulses is a rotor and stator combination where a rotor can be rotated relative to the fixed stator between an open flow position where there is no restriction of mud flowing through the valve and no pulse is generated, and a restricted flow position where there is restriction of mud flowing through the valve and a pressure pulse is generated.

SUMMARY OF THE PREFERRED EMBODIMENTS

According to a first aspect, there is provided a telemetry tool comprising: (a) a pulser assembly comprising a housing and a driveshaft extending out of an opening in the housing; (b) a primary seal surrounding and sealing against the driveshaft to seal the opening in the housing; (c) a fluid pressure pulse generator comprising a stator with a bore therethrough configured to fixedly attach to the housing or to a drill collar surrounding the fluid pressure pulse generator, and a rotor fixedly attached to the driveshaft, wherein the driveshaft and rotor are rotatable relative to the fixed stator; and (d) a secondary seal seated in the stator bore, the secondary seal surrounding and sealing against a portion of the driveshaft extended out of the housing or a portion of the rotor.

An internal surface of the stator may comprise an annular shoulder against which the secondary seal abuts. The secondary seal may be a wiper seal. The wiper seal may be a comb wiper seal.

The telemetry tool may further comprise a retainer configured to retain the secondary seal within the stator bore. The retainer may releasably retain the secondary seal within the stator bore.

The rotor may comprise a rotor body fixedly attached to the driveshaft and at least a portion of the rotor body may be received within the stator bore. The secondary seal may surround and seal against the rotor body or the secondary seal may surround and seal against the driveshaft.

There may be a fluid flow channel between adjacent longitudinal surfaces of the rotor body and the stator and the fluid flow channel may define at least a portion of a tortuous flow path for drilling fluid which flows from external the fluid pressure pulse generator, past the secondary seal to the primary seal when the telemetry tool is positioned downhole. The tortuous flow path may include at least one change in direction. The tortuous flow path may comprise at least one restricted point and at least one expansion zone, whereby the cross sectional area of the restricted point may be less than the cross sectional area of the expansion zone. An entrance to the fluid flow channel may be downhole relative to the primary seal or an entrance to the fluid flow channel may be uphole relative to the primary seal.

The stator may comprise a stator body with the stator bore therethrough and a plurality of radially extending stator projections spaced around the stator body whereby spaced stator projections define stator flow channels therebetween. A plurality of radially extending rotor projections may be spaced around the rotor body. The stator projections may be positioned between the rotor projections and the housing. The rotor projections may be axially adjacent and rotatable relative to the stator projections such that the rotor projections move in and out of fluid communication with the stator flow channels to create fluid pressure pulses in drilling fluid flowing through the stator flow channels.

According to another aspect, there is provided a telemetry tool comprising: (a) a pulser assembly comprising a housing and a driveshaft extending out of an opening in the housing; (b) a seal surrounding and sealing against the driveshaft to seal the opening in the housing; and (c) a fluid pressure pulse generator comprising a stator with a bore therethrough fixedly attached to the housing and a rotor comprising a rotor body fixedly attached to the driveshaft. At least a portion of the rotor body is received within the stator bore, and the driveshaft and rotor are rotatable relative to the fixed stator. A fluid flow channel extends between adjacent longitudinal surfaces of the rotor body and the stator and the fluid flow channel defines at least a portion of a tortuous flow path for drilling fluid which flows from external the fluid pressure pulse generator to the seal when the telemetry tool is positioned downhole.

The tortuous flow path may include at least one change in direction. The tortuous flow path may comprise at least one restricted point and at least one expansion zone, whereby the cross sectional area of the restricted point may be less than the cross sectional area of the expansion zone.

An entrance to the fluid flow channel may be downhole relative to the seal or an entrance to the fluid flow channel may be uphole relative to the seal.

The stator may comprise a stator body with the stator bore therethrough and a plurality of radially extending stator projections spaced around the stator body whereby spaced stator projections define stator flow channels therebetween. A plurality of radially extending rotor projections may be spaced around the rotor body. The stator projections may be positioned between the rotor projections and the housing. The rotor projections may be axially adjacent and rotatable relative to the stator projections such that the rotor projections move in and out of fluid communication with the stator flow channels to create fluid pressure pulses in the drilling fluid flowing through the stator flow channels.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
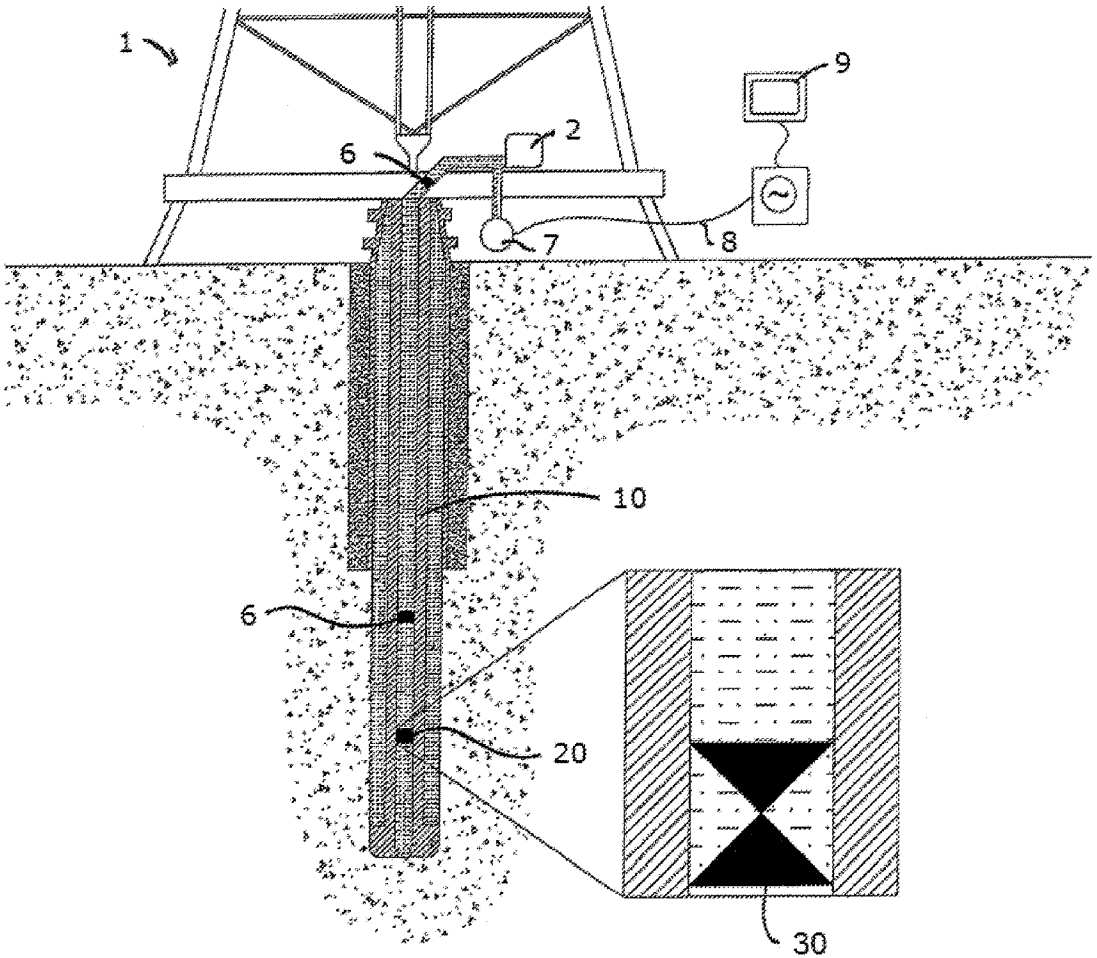
FIG. 1 is schematic of a drill string in an oil and gas borehole comprising a MWD telemetry tool.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but are not necessarily, references to the same embodiment; and, such references are intended to refer to at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to one of skill in the art regarding the description of the disclosure. For convenience, certain terms may be highlighted, for example using italics and/or quotation marks. The use of any such highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein.

Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein generally relate to a telemetry tool with a fluid pressure pulse generator that can generate fluid pressure pulses. The telemetry tool may be used for mud pulse ("MP") telemetry used in downhole drilling, wherein a drilling fluid or mud (herein referred to as "mud") is used to transmit telemetry pulses to surface. The telemetry tool may alternatively be used in other methods where it is necessary to generate a fluid pressure pulse. The fluid pressure pulse generator comprises a stator and a rotor. The stator may be fixed to a pulser assembly of the telemetry tool or to a drill collar housing the telemetry tool, and the rotor is fixed to a driveshaft extending from the pulser assembly. The driveshaft and rotor rotate relative to the fixed stator to generate pressure pulses in mud flowing through the fluid pressure pulse generator.

Referring to the drawings and specifically to FIG. 1, there is shown a schematic representation of MP telemetry operation using a fluid pressure pulse generator 30. The fluid pressure pulse generator is part of a measurement while drilling ("MWD") tool 20. In downhole drilling equipment 1, mud is pumped down a drill string by pump 2 and passes through the fluid pressure pulse generator 30 of the MWD tool 20. The fluid pressure pulse generator 30 has an open flow position in which mud flows relatively unimpeded through the pressure pulse generator 30 and no pressure pulse is generated and a restricted flow position where flow of mud through the pressure pulse generator 30 is restricted and a positive pressure pulse is generated (represented schematically as block 6 in mud column 10). Information acquired by downhole sensors (not shown) is transmitted in specific time divisions by pressure pulses 6 in the mud column 10. More specifically, signals from sensor modules (not shown) in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which controls timing of the fluid pressure pulse generator 30 to generate pressure pulses 6 in a controlled pattern which contain the encoded data. The pressure pulses 6 are transmitted to the surface and detected by a surface pressure transducer 7 and decoded by a surface computer 9 communicative with the transducer 7 by cable 8. The decoded signal can then be displayed by the computer 9 to a drilling operator. The characteristics of the pressure pulses 6 are defined by duration, shape, and frequency and these characteristics are used in various encoding systems to represent binary data as is known in the art.

Figure 2:
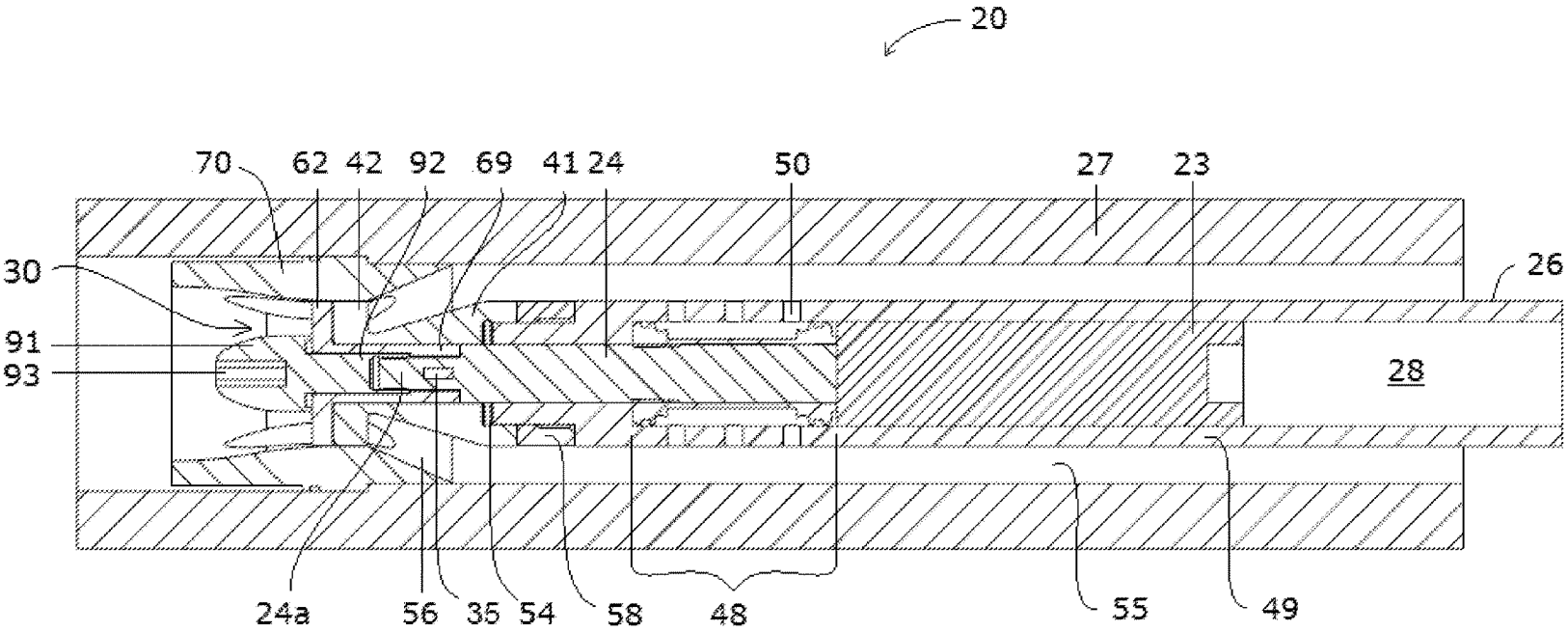
FIG. 2 is a longitudinally sectioned view of a mud pulser section of the MWD tool that includes a pulser assembly comprising a housing and a driveshaft extending out of the housing, a fluid pressure pulse generator comprising a stator fixed to the housing and a rotor fixed to the driveshaft, and a flow bypass sleeve that surrounds the fluid pressure pulse generator.
Figure 3:
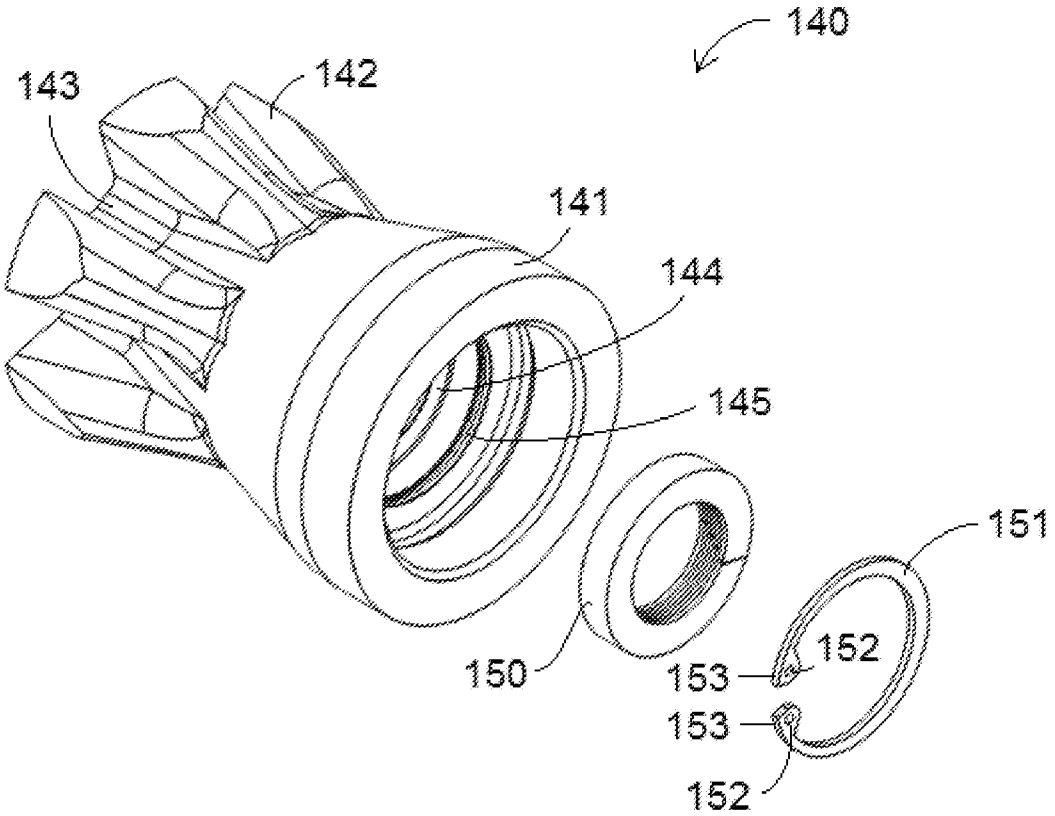
FIG. 3 is an exploded perspective view of a stator according to a first embodiment including a wiper seal and retaining ring.
Figure 4:
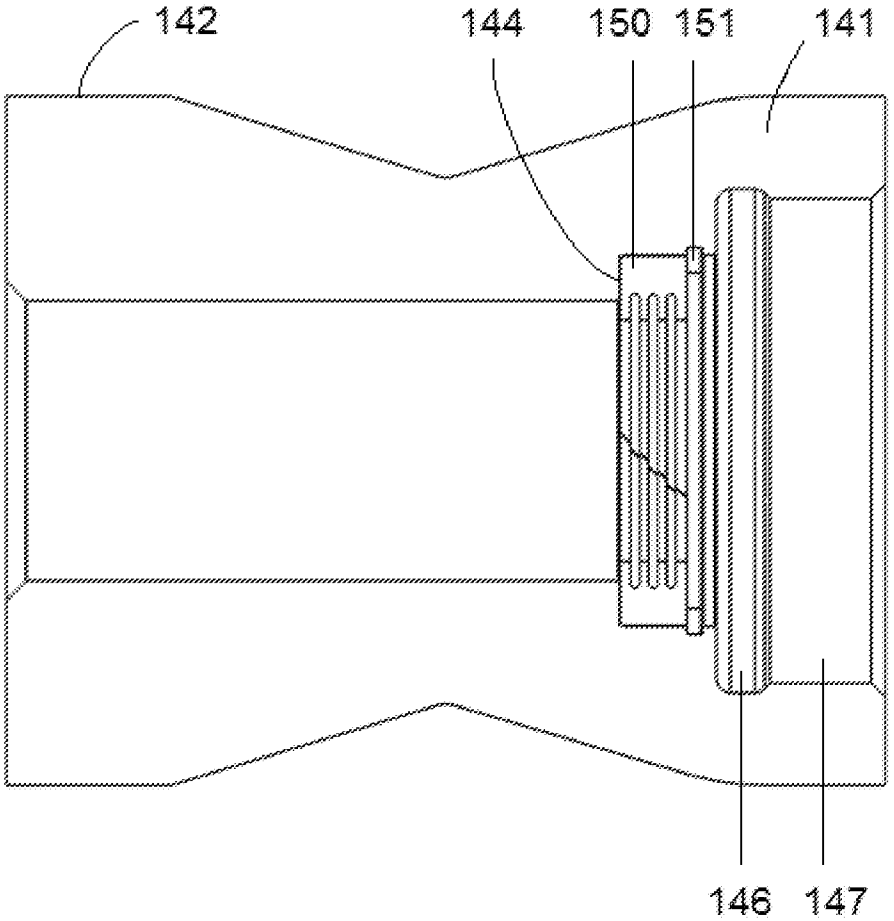
FIG. 4 is a longitudinally sectioned view of the stator of FIG. 3.
Figure 5:
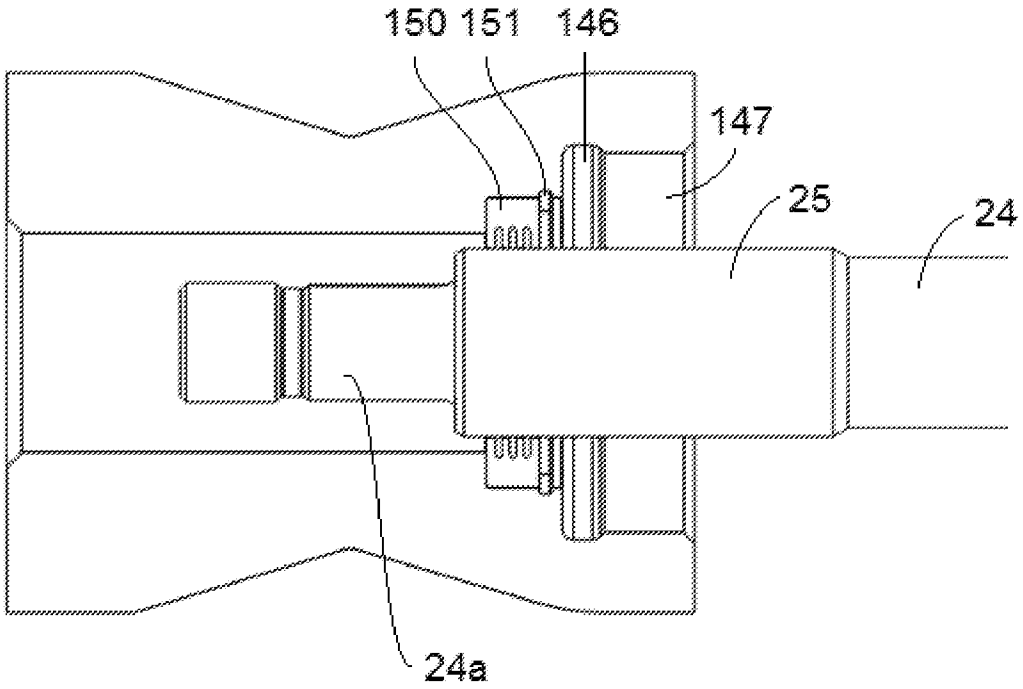
FIG. 5 is a longitudinally sectioned view of the stator of FIG. 3 showing an un-sectioned driveshaft of the pulser assembly extending into the stator with the wiper seal surrounding and sealing against the driveshaft.

Referring to FIG. 2, the mud pulser section of the MWD tool 20 is shown in more detail. The MWD tool 20 generally comprises the fluid pressure pulse generator 30 and a pulser assembly 26 which takes measurements while drilling and which drives the fluid pressure pulse generator 30. The fluid pressure pulse generator 30 and pulser assembly 26 are axially located inside a drill collar 27. A flow bypass sleeve 70 surrounds the fluid pressure pulse generator 30. In the embodiment described herein, the fluid pressure pulse generator 30 is at the downhole end of the MWD tool 20, however in alternative embodiments, the fluid pressure pulse generator 30 may be positioned at the uphole end of the MWD tool 20.

The pulser assembly 26 is fixed to the drill collar 27 with an annular channel 55 therebetween and mud flows along the annular channel 55 when the MWD tool 20 is downhole. The pulser assembly 26 comprises pulser assembly housing 49 enclosing a motor subassembly and an electronics subassembly 28 electronically coupled together but fluidly separated by a feed-through connector (not shown). The motor subassembly includes a motor and gearbox subassembly 23, a driveshaft 24 coupled to the motor and gearbox subassembly 23, and a pressure compensation device 48. The fluid pressure pulse generator 30 comprises a stator and a rotor. The stator comprises a stator body 41 with a bore therethrough and stator projections 42 radially extending around the downhole end of the stator body 41. The rotor comprises a generally cylindrical rotor body 69 with a central bore therethrough and a plurality of radially extending projections 62 at the downhole end thereof.

The stator body 41 comprises a cylindrical section at the uphole end and a generally frusto-conical section at the downhole end which tapers longitudinally in the downhole direction. The cylindrical section of stator body 41 is coupled with the pulser assembly housing 49. More specifically, a jam ring 58 threaded on stator body 41 is threaded onto pulser assembly housing 49. Once the stator is positioned correctly, the stator is held in place and the jam ring 58 is backed off and torqued against the stator body 41 holding it in place.

The rotor body 69 is received in the downhole end of the bore through the stator body 41 and a downhole portion 24*a* of the driveshaft 24 is received in the uphole end of the bore through the rotor body 69. A coupling key 35 extends through downhole driveshaft portion 24*a* and is received in a coupling key receptacle (not shown) at the uphole end of the rotor body 69 to couple the driveshaft 24 with the rotor body 69. In alternative embodiments the rotor body 69 may not have a bore therethrough which receives the driveshaft portion 24*a*, and alternative means of coupling the rotor body 69 to the driveshaft 24 may be used as would be known to a person skilled in the art.

A rotor cap comprising a cap body 91 and a cap shaft 92 is positioned at the downhole end of the fluid pressure pulse generator 30. The cap shaft 92 is received in the downhole end of the bore through the rotor body 69 and threads onto downhole driveshaft portion 24*a* to lock (torque) the rotor to the driveshaft 24. The cap body 91 includes a hexagonal shaped opening 93 dimensioned to receive a hexagonal Allen key which is used to torque the rotor to the driveshaft 24. The rotor cap therefore releasably couples the rotor to the driveshaft 24 so that the rotor can be easily removed and repaired or replaced if necessary using the Allen key. In alternative embodiments, the rotor cap may not be present.

Rotation of the driveshaft 24 by the motor and gearbox subassembly 23 rotates the rotor relative to the fixed stator. The electronics subassembly 28 includes downhole sensors, control electronics, and other components required by the MWD tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor in a controlled pattern to generate pressure pulses 6 representing the carrier wave for transmission to surface as described above with reference to FIG. 1. In alternative embodiments, the rotor may be rotated by a blade array (not shown) in the flow path of mud flowing through the fluid pressure pulse generator. The blade array may include blades that are angled relative to the direction of flow of mud through the fluid pressure pulse generator, thereby causing the rotor to rotate when mud flows past the blades.

The driveshaft 24 extends out of pulser assembly housing 49 through an opening in the pulser assembly housing 49. The motor subassembly is filled with a lubricating liquid such as hydraulic oil or silicon oil and this lubricating liquid is fluidly separated from mud flowing along the annular channel 55 by an annular primary seal 54. Primary seal 54 surrounds and seals against the driveshaft 24 or a sealing cylinder 25 (shown in FIGS. 6*a* and 6*b*) or the like surrounding the driveshaft 24. The pressure compensation device 48 comprises a flexible membrane (not shown) in fluid communication with the lubrication liquid on one side and with mud on the other side via ports 50 in the pulser assembly housing 49; this allows the pressure compensation device 48 to maintain the pressure of the lubrication liquid at about the same pressure as the mud in the annular channel 55. Without pressure compensation, the torque required to rotate the driveshaft 24 and rotor would need high current draw with excessive battery consumption which may result in increased costs. In alternative embodiments (not shown), the pressure compensation device 48 may be any pressure compensation device known in the art, such as pressure compensation devices that utilize pistons, rubber membranes, or a bellows style pressure compensation mechanism.

Mud pumped from the surface by pump 2 flows along annular channel 55 between the outer surface of pulser assembly housing 49 and the inner surface of drill collar 27. When the mud reaches the fluid pressure pulse generator 30 it flows along an annular channel 56 provided between the external surface of the stator body 41 and the internal surface of the flow bypass sleeve 70 and hits the stator projections 42 where the mud is channeled through stator flow channels defined by adjacently positioned stator projections 42. Some mud also flows along bypass channels provided by the flow bypass sleeve 70. The rotor projections 62 are axially adjacent and downhole relative to the stator projections 42 and rotate in and out of fluid communication with the stator flow channels to generate pressure pulses 6 in mud flowing through the fluid pressure pulse generator 30.

The external dimensions of flow bypass sleeve 70 may be adapted to fit any sized drill collar 27. It is therefore possible to use a one size fits all fluid pressure pulse generator 30 with multiple sized flow bypass sleeves 70 with various different external circumferences that are dimensioned to fit different sized drill collars 27. Each of the multiple sized flow bypass sleeves 70 may have the same internal dimensions to receive the one size fits all fluid pressure pulse generator 30 but different external dimensions to fit the different sized drill collars 27. In larger diameter drill collars 27 the volume of mud flowing through the drill collar 27 will generally be greater than the volume of mud flowing through smaller diameter drill collars 27, however the bypass channels of the flow bypass sleeve 70 may be dimensioned to accommodate this greater volume of mud. The bypass channels of the different sized flow bypass sleeves 70 may therefore be dimensioned such that the volume of mud flowing through the one size fits all fluid pressure pulse generator 30 fitted within any sized drill collar 27 is within an optimal range for generation of pressure pulses 6 which can be detected at the surface without excessive pressure build up. It may therefore be possible to control the flow rate of mud through the fluid pressure pulse generator 30 using different flow bypass sleeves 70 rather than having to fit different sized fluid pressure pulse generators 30 to the pulser assembly 26.

In alternative embodiments (not shown), the fluid pressure pulse generator 30 may be present in the drill collar 27 without the flow bypass sleeve 70. In these alternative embodiments, the stator projections 42 and rotor projections 62 may radially extend to have an external diameter that is greater than the external diameter of the cylindrical section of the stator body 41, such that mud following along annular channel 55 impinges on the stator projections 42 and is directed through the stator flow channels. The stator projections 42 and rotor projections 62 may radially extend to meet the internal surface of the drill collar 27. There may be a small gap between the rotor projections 62 and the internal surface of the drill collar 27 to allow rotation of the rotor projections 62. The innovative aspects apply equally in embodiments such as these.

Referring to FIGS. 3 to 6 there is shown a stator 140 according to a first embodiment. The stator 140 comprises stator body 141 with a bore therethrough and stator projections 142 equidistantly spaced around the downhole end of the stator body 141. Stator flow channels 143 are defined by adjacently spaced stator projections 142. A secondary seal 150 is received in the uphole end of the bore through the stator body 141. The internal surface of the stator body 141 is configured to seat the secondary seal 150 and the secondary seal 150 abuts an annular shoulder 144 on the internal surface of the stator body 141. An annular groove 145 in the internal surface of the stator body 141 receives a retaining ring 151 configured to retain the secondary seal 150 in position in the stator bore. In the embodiment shown in FIGS. 3 to 6, the secondary seal 150 is an annular comb wiper seal with a grooved or ridged internal surface; however any type of wiper seal or comb wiper seal known in the art that fits within the stator body can be used. In alternative embodiments, the secondary seal 150 may be any type of annular seal known in the art, for example a SKF™ guide ring FO7, a SKF™ rotary seal RO1-F or the like. The retaining ring 151 comprises a generally C-shaped ring with two ends 153 that are spaced apart when the retaining ring 151 is in its normal configuration. The ends 153 each have an aperture 152 therethrough for receiving a tool that can be used to bring the ends 153 towards each other to reduce the outer diameter of the retaining ring 151 such that the retaining ring 151 can be removed from or positioned within the groove 145 in the internal surface of the stator body 141. The retaining ring 151 therefore releasably retains the secondary seal 150 in position within the stator bore, so that the secondary seal 150 may be removed and repaired or replaced if the secondary seal 150 becomes worn or damaged through mud erosion. In alternative embodiments, an alternative retainer for retaining the secondary seal 150 in position in the bore of the stator body 141 may be used for example, the retainer may be a threaded ring or other axial retainer known in the art. The retainer may fixedly or releasably retain the secondary seal 150 within the stator bore. In further alternative embodiments, no retainer may be present.

The driveshaft 24 is received in the uphole end of the bore through the stator body 141. The downhole end of pulser assembly housing 49 is received in cavities 146 and 147 in the stator body 141 and jam ring 58 is backed off and torqued against the stator body 141 holding it in place as described above in more detail with reference to FIG. 2. A sealing cylinder 25 surrounds a portion of the downhole end of the driveshaft 24 and the secondary seal 150 surrounds and seals against the sealing cylinder 25. The primary seal 54 is seated in the pulser assembly housing 49 and also seals against the sealing cylinder 25. The sealing cylinder 25 may be made of ceramic material, such as zirconia, or carbide and provides a surface against which the primary seal 54 and secondary seal 150 can seal upon. In alternative embodiments, sealing cylinder 25 may not be present and the primary seal 54 and secondary seal 150 may seal against the outer surface of driveshaft 24. By "sealing against the driveshaft" it is meant sealing against the surface of the driveshaft 24 or against the surface of any structure or object (such as sealing cylinder 25) which surrounds the driveshaft 24. Driveshaft portion 24*a* is received in the uphole end of the bore through the rotor body 69. Cap shaft 92 of the rotor cap is received in the downhole end of the bore through the rotor body 69 and threads onto downhole driveshaft portion 24*a* to lock (torque) the rotor body 69 to the driveshaft 24 as described above with reference to FIG. 2.

Figure 6A:
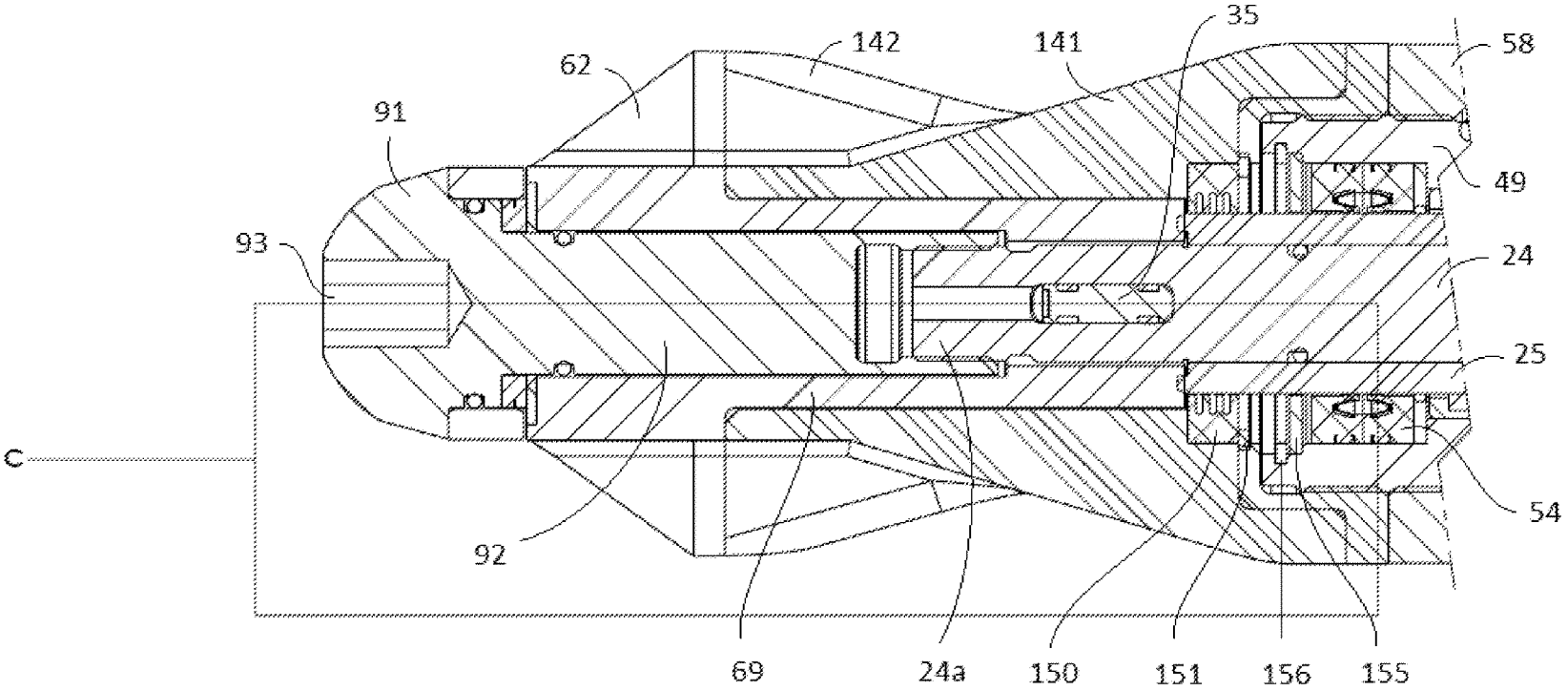
FIG. 6*a* is a longitudinally sectioned view of the MWD tool showing the stator of FIG. 3 fixed to the pulser assembly housing and the driveshaft extending into the stator and fixed to the rotor by a rotor cap, with the wiper seal surrounding and sealing against the driveshaft.
Figure 6B:
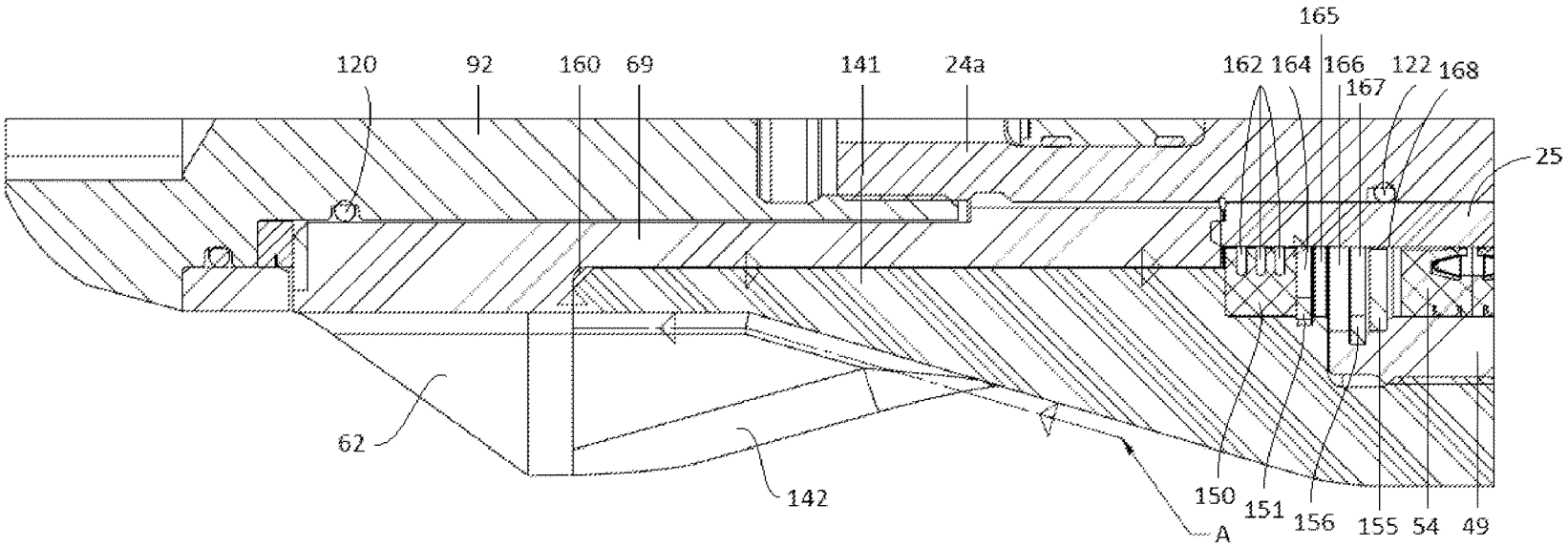
FIG. 6*b* is a detailed view of section C in FIG. 6*a* showing the flow path of drilling mud entering the fluid pressure pulse generator.

As shown in FIGS. 6*a* and 6*b*, the primary seal 54 is held in place by a seal retention washer 155 positioned downhole of the seal, and a washer retaining ring 156 is positioned downhole of the washer 155 to hold the washer 155 in place. In alternative embodiments, the seal retention washer 155 and washer retaining ring 156 may not be present and some other means of holding the primary seal 54 in place in the pulser assembly housing 49 may be used. An O-ring seal 120 provides a fluid tight seal between the cap shaft 92 and the internal surface of the rotor body 69 and an O-ring seal 122 provides a fluid tight seal between the internal surface of the sealing cylinder 25 and the external surface of the driveshaft 24.

When the MWD tool 20 is downhole, mud flows through the stator flow channels 143 and a small amount of mud may enter the fluid pressure pulse generator 30 between the downhole end of the stator body 141 and the rotor body 69. The mud flows along a mud flow path represented by arrows A in FIG. 6*b*. More specifically, the mud flows between the internal surface of the stator body 141 and the external surface of the rotor body 69 until it reaches the secondary seal 150. The mud then flows between the internal surface of the secondary seal 150 and the external surface of sealing cylinder 25 (or the external surface of the driveshaft 24 if sealing cylinder 25 is not present) and through retention rings 151 and 156 and retention washer 155 before reaching primary seal 54.

Figure 7:
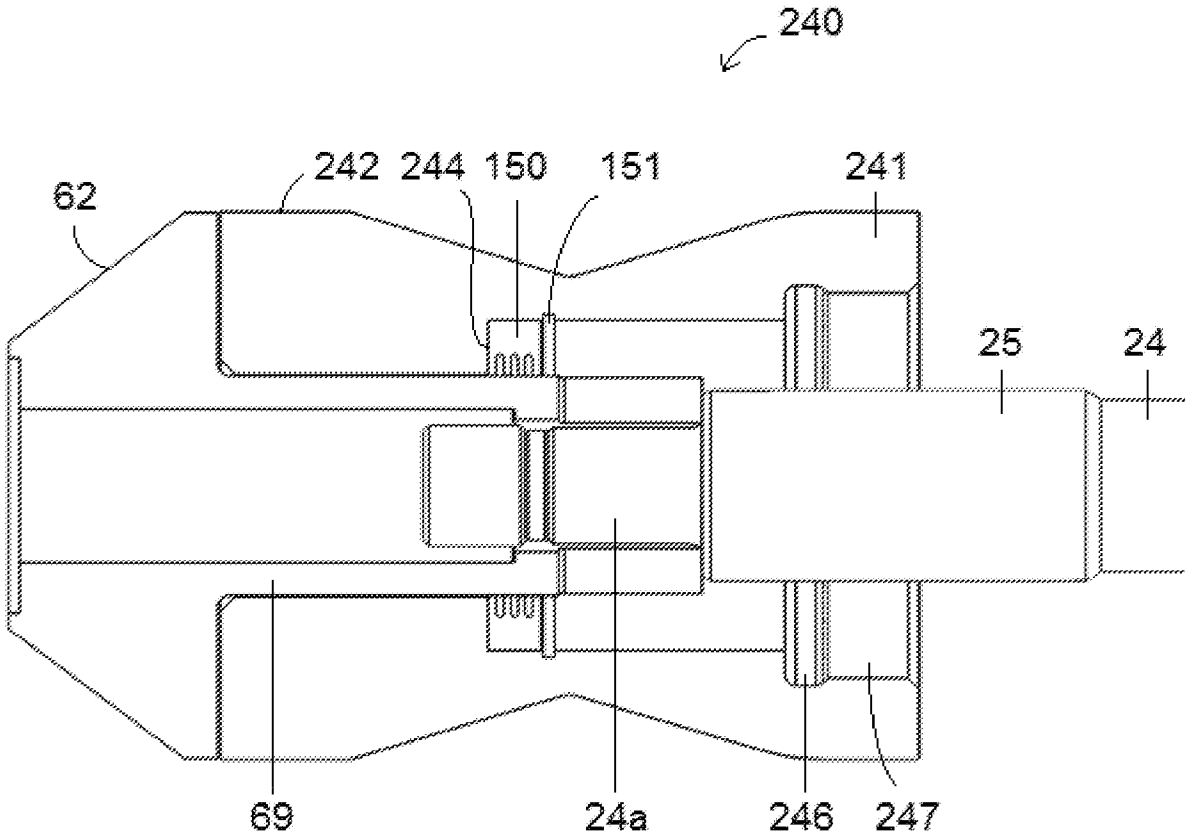
FIG. 7 is a longitudinally sectioned view of a stator according to a second embodiment including a wiper seal and retaining ring and showing an un-sectioned driveshaft of the pulser assembly extending into the stator and fixed to the rotor with the wiper seal surrounding and sealing against the rotor.

Referring now to FIG. 7, there is shown a stator 240 according to a second embodiment comprising stator body 241 with a bore therethrough and stator projections 242 equidistantly spaced around the downhole end of the stator body 241. As with the stator 140 of the first embodiment, the internal surface of the stator body 241 is shaped to seat secondary seal 150 and includes an annular shoulder 244 against which the secondary seal 150 abuts, however annular shoulder 244 is positioned further downhole relative to annular shoulder 144 of the stator 140 of the first embodiment. Retaining ring 151 is received in a groove in the internal surface of the stator body 241 to releasably retain the secondary seal 150 in position within the stator body 241 as described in more detail above with reference to FIGS. 3 to 6. The driveshaft 24 is received in the uphole end of the bore through the stator body 241 and passes through the secondary seal 150 and retaining ring 151. The rotor body 69 is received in the downhole end of the bore through the stator body 241 and surrounds the downhole portion 24*a* of the driveshaft 24. The secondary seal 150 surrounds and seals against the rotor body 69. In alternative embodiments, a sealing cylinder (not shown) may surround the rotor body and secondary seal 150 may seal against the sealing cylinder. By "sealing against a portion of the rotor" it is meant sealing against the surface of the rotor or against the surface of any structure or object (such as a sealing cylinder) which surrounds the rotor. The downhole end of pulser assembly housing 49 is received in cavities 246 and 247 in the stator body 241 and a jam ring 58 may be backed off and torqued against the stator 240 holding it in place as described above in more detail with reference to FIG. 2. The primary seal 54 is seated in the pulser assembly housing 49 and seals against the sealing cylinder 25 surrounding the driveshaft 24. As with the first embodiment of the stator 140, a small amount of mud may enter between the downhole end of the stator body 241 and the rotor body 69 and travel uphole between the external surface of the rotor body 69 and the internal surface of the stator body 241 towards the secondary and primary seals 150, 54.

In both embodiments of the stator 140, 240, the secondary seal 150 may reduce the amount of mud, grit and debris impinging on the primary seal 54 which could otherwise cause wear or damage to primary seal 54. Secondary seal 150 may therefore beneficially extend the life of primary seal 54 and reduce the likelihood of mud entering the pulser assembly 26 and lubrication liquid leaving the pulser assembly 26. As the mud impinges on the secondary seal 150 before it reaches the primary seal 54, the secondary seal 150 may become worn or damaged over time through exposure to mud, however, the secondary seal 150 may be removed and replaced if needed as described above in more detail.

The fluid pressure pulse generator 30 may be configured to provide a tortuous flow path for mud which flows between adjacent longitudinal surfaces of the stator and the rotor to the primary seal 54. The tortuous flow path may change direction one or more times and may include one or more restriction points and expansion zones which may reduce the momentum of mud flow and may therefore reduce the velocity of mud reaching the primary seal 54.

An exemplary tortuous flow path is represented by arrows A in FIG. 6*b*. As discussed above, a small amount of mud flowing through the stator flow channels 143 may enter between the downhole end of the stator body 141 and the rotor body 69. This entry point presents a first change in direction and first restriction point of the mud flow path. Expansion chamber 160 provides a first expansion point and second change in direction of the flow path. The flow path then restricts again and mud flows between the external surface of the rotor body 69 and the external surface of the stator body 141. The flow path has a further change in direction before mud flows between the internal surface of the secondary seal 150 and the external surface of the sealing cylinder 25. In the embodiment shown in FIG. 6*b*, the secondary seal 150 is a comb wiper seal which provides several expansion zones 162 and restriction points for the mud as it flows along flow path A. A further expansion zone is provided by chamber 164 between the retaining ring 151 and the sealing cylinder 25. Mud collects in chambers 164, 165, 166 and 167 which provide a large volume increase thereby reducing the velocity of mud flow. A further restriction point is provided as the mud flows between the internal surface of retention washer 155 and the external surface of the sealing cylinder 25. The mud then collects in a final expansion zone 168 before reaching the primary seal 54. The mud flow path therefore changes direction and has numerous restriction points and expansion zones before reaching primary seal 54. In alternative embodiments, the tortuous mud flow path may have an increased or decreased number of directional changes, restriction points and/or expansion zones to those shown in FIG. 6*b*. The innovative aspects of the invention apply equally in embodiments such as these.

Frictional losses, known as Moody-type friction losses, occur as the mud flows along the flow path reducing the energy of mud flow. In addition, the tortuous nature of the flow path may provide additional minor energy losses to the mud flowing through the flow path. The energy losses resulting from the tortuous flow path can be quantified by a dimensionless loss coefficient K which is usually given as a ratio of the head loss $$h_m = \frac{\Delta\rho}{\rho g} hm = \Delta\rho\rho g$$

to the velocity $$\text{head}\frac{v^2}{2g}$$

through the area of concern:

$$K = \frac{h_m}{V^2/(2g)} = \frac{\Delta\rho}{\frac{1}{2}\rho V^2}$$

The total head loss $\Delta h_{tot}$ of a system can be determined by separately summing all losses, namely frictional $h_f$ and minor $h_m$ losses as follows:

$$\Delta h_{tot} = h_f + \Sigma h_m$$

Calculation of these energy losses is generally known in the art.

The energy losses from frictional losses and from the tortuous nature of the mud flow path typically result in essentially stagnant or slow moving mud reaching the primary seal 54, which may beneficially reduce wear of the primary seal 54. The sealing cylinder 25, primary seal 54 and other parts of the primary seal assembly (for example, the seal retention washer 155 and washer retaining ring 156) are strategically positioned near the end of the tortuous flow path where the velocity of flow of mud is reduced instead of being positioned in the fast flowing mud at the beginning of the tortuous flow path. The sealing cylinder 25, primary seal 54 and other parts of the seal assembly are also positioned uphole of the entry point of mud into the MWD tool 20, therefore the mud must flow uphole against gravity and in the opposite direction of the general mud flow in order to reach these components. In alternative embodiments the entry point of mud into the MWD tool 20 may be downhole relative to the sealing cylinder 25, primary seal 54 and other parts of the seal assembly, however, as mud flows past the entry point venturi forces may be created that suck mud out of the tortuous flow path. As a result wear of the primary sealing cylinder 25, primary seal 54 and other parts of the primary seal assembly may be reduced, thereby increasing their life.

In alternative embodiments (not shown) the fluid pressure pulse generator may be any rotor/stator type fluid pressure pulse generator where the stator includes flow channels or orifices through which mud flows and the rotor rotates relative to the fixed stator to move in and out of fluid communication with the flow channels or orifices to generate pressure pulses 6. The fluid pressure pulse generator may be positioned at either the downhole or uphole end of the MWD tool 20.

Figure 8:
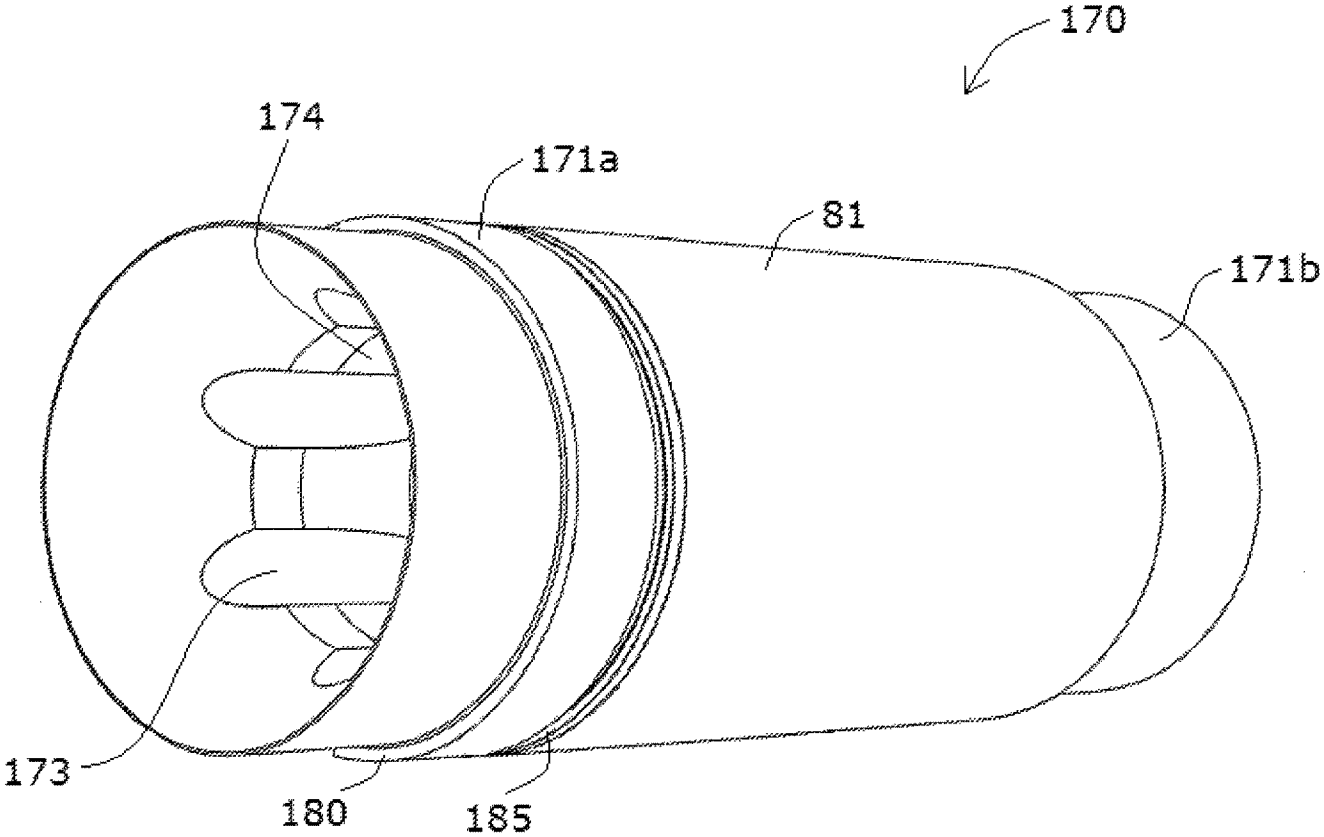
FIG. 8 is a perspective view of a first embodiment of the flow bypass sleeve.
Figure 9:
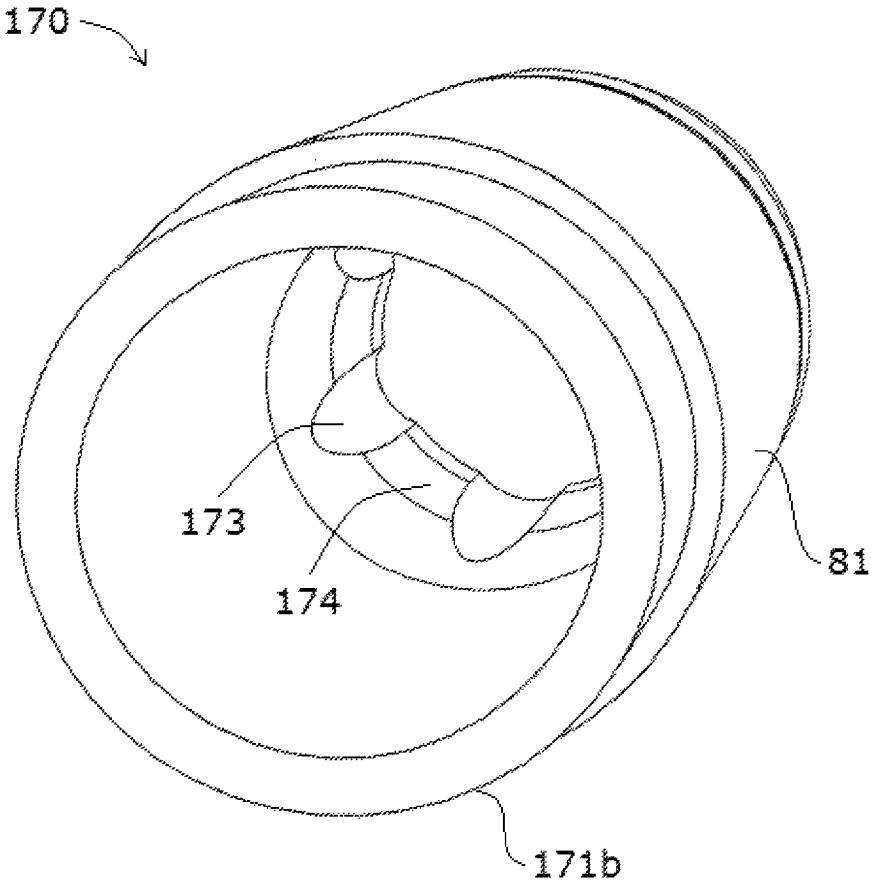
FIG. 9 is a perspective view of the downhole end of the flow bypass sleeve of FIG. 8.
Figure 10:
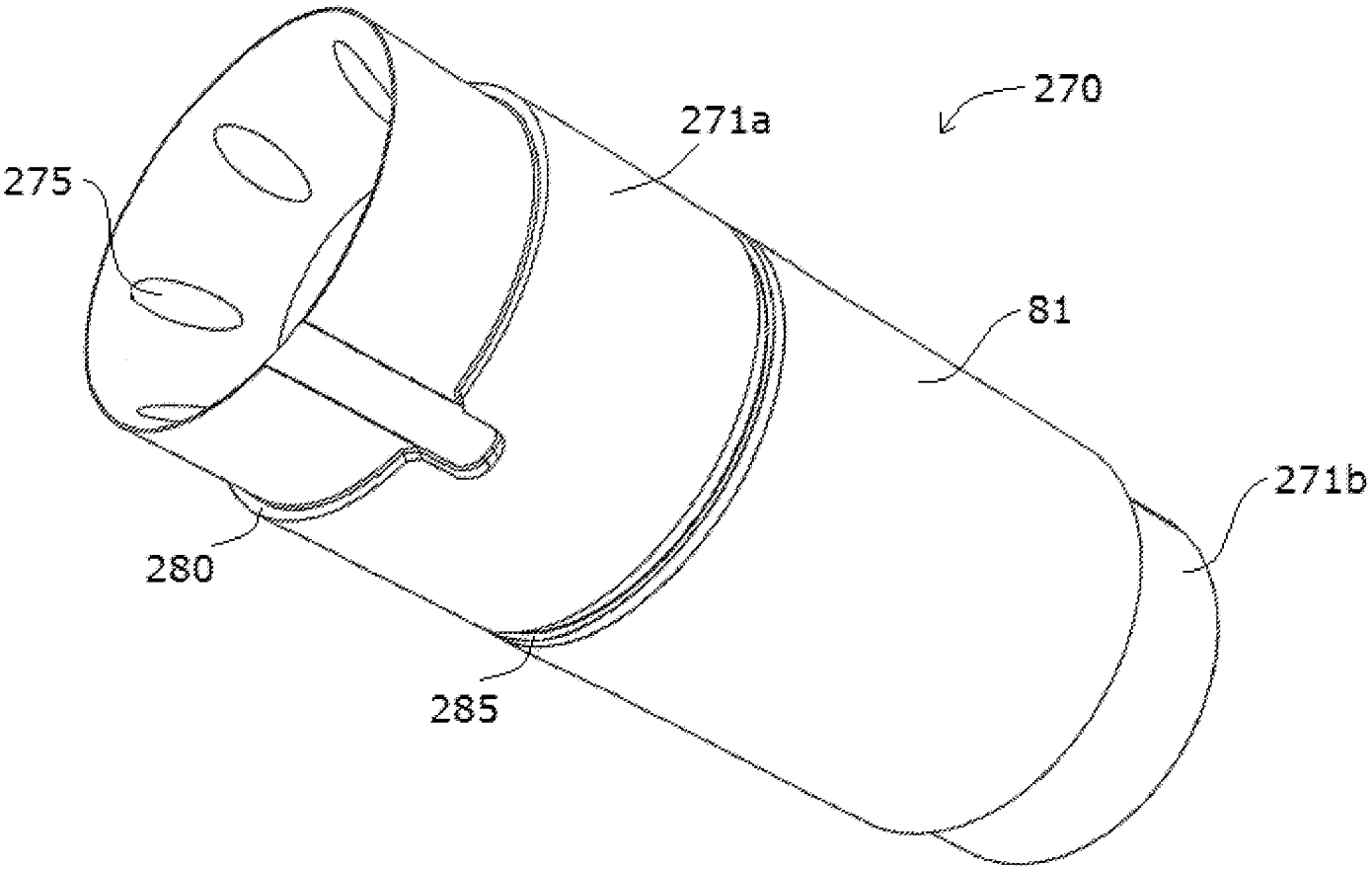
FIG. 10 is a perspective view of a second embodiment of the flow bypass sleeve.
Figure 11:
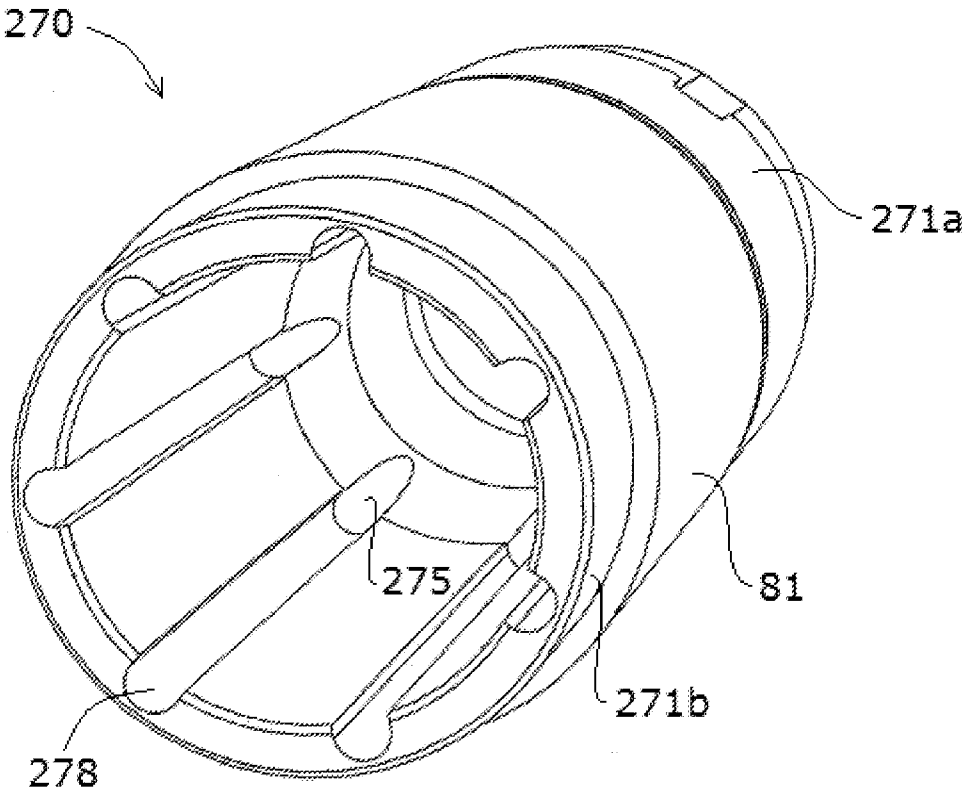
FIG. 11 is a perspective view of the downhole end of the flow bypass sleeve of FIG. 10.

Referring now to FIGS. 8 and 9 there is shown a first embodiment of flow bypass sleeve 170 comprising a generally cylindrical sleeve body with a central bore therethrough made up of an uphole body portion 171*a* and a downhole body portion 171*b*. Referring to FIGS. 10 and 11 there is shown a second embodiment of flow bypass sleeve 270 comprising a generally cylindrical sleeve body with a central bore therethrough made up of an uphole body portion 271*a* and a downhole body portion 271*b*.

During assembly of the first and second embodiments of the flow bypass sleeve 170, 270, the uphole and downhole body portions 171*a,b* and 271*a,b* are axially aligned and a lock down sleeve 81 is slid over the downhole end of the downhole body portion 171*b*, 271*b* and moved towards the uphole body portion 171*a*, 271*b* until the uphole edge of the lock down sleeve 81 abuts an annular shoulder on the external surface of uphole body portion 171*a*, 271*a*. The assembled flow bypass sleeve 170, 270 can then be inserted into the downhole end of drill collar 27. The external surface of uphole body portion 171*a*, 271*a* includes an annular shoulder 180, 280 near the uphole end of uphole body portion 171*a*, 271*a* which abuts a downhole shoulder of a keying ring (not shown) that is press fitted into the drill collar 27. A threaded ring (not shown) fixes the flow bypass sleeve 170, 270 within the drill collar 27. A groove 185, 285 on the external surface of the uphole body portion 171*a*, 271*a* receives an o-ring (not shown) and a rubber back-up ring (not shown) such as a parbak to help seat the flow bypass sleeve 170, 270 and reduce fluid leakage between the flow bypass sleeve 170, 270 and the drill collar 27. In alternative embodiments the flow bypass sleeve 170, 270 may be assembled or fitted within the drill collar 27 using alternative fittings as would be known to a person of skill in the art.

In the first embodiment of the flow bypass sleeve 170, the internal surface of the uphole body portion 171*a* includes a plurality of longitudinal extending grooves 173. Grooves 173 are equidistantly spaced around the internal surface of the uphole body portion 171*a*. Internal walls 174 in-between each groove 173 align with the stator projections 42 of the fluid pressure pulse generator 30, and the grooves 173 align with the stator flow channels. The flow bypass sleeve 170 may be precisely located with respect to the drill collar 27 using a keying notch (not shown) to ensure correct alignment of the stator projections 42 with the internal walls 174. The rotor projections 62 rotate relative to the flow bypass sleeve 170 as the rotor moves between the open flow position and the restricted flow position as described above in more detail.

In the second embodiment of the flow bypass sleeve 270 a plurality of apertures 275 extend longitudinally through the uphole body portion 271*a*. The apertures 275 are circular and equidistantly spaced around uphole body portion 271*a*. The internal surface of the downhole body portion 271*b* includes a plurality of spaced grooves 278 which align with the apertures 275 in the assembled flow bypass sleeve 270 (shown in FIG. 11), such that mud is channelled through the apertures 275 and into grooves 278. The internal surface of uphole body portion 271*a* which surrounds the rotor and stator projections 62, 42 is uniform in this embodiment; therefore there is no need to align the stator projections 42 with any internal feature of the uphole body portion 271*a* as with the first embodiment of the flow bypass sleeve 170 described above. In alternative embodiments (not shown) the apertures 275 may be any shape and need not be equidistantly spaced around the sleeve body. The number and size of the apertures 275 may be chosen for the desired amount of mud flow therethrough. In further alternative embodiments (not shown) the grooves 278 may have a different shape or may not be present at all. In further alternative embodiments (not shown) the sleeve body may include aperture 275 and internal grooves 173 in the uphole body portion 271*a*.

While particular embodiments have been described in the foregoing, it is to be understood that other embodiments are possible and are intended to be included herein. It will be clear to any person skilled in the art that modifications of and adjustments to the foregoing embodiments, not shown, are possible.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for.") Accordingly, the applicant reserves the right to add additional claims after filing the application to pursue such additional claim forms for other aspects of the disclosure.

Although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A telemetry tool comprising:

(a) a pulser assembly comprising a housing and a driveshaft extending out of an opening in the housing;

(b) a primary seal surrounding the driveshaft and sealing the opening in the housing while allowing rotation of the driveshaft relative to the housing;

(c) a fluid pressure pulse generator comprising a stator with a bore therethrough configured to fixedly attach to the housing or to a drill collar surrounding the fluid pressure pulse generator, and a rotor fixedly attached to the driveshaft, wherein the driveshaft and rotor are rotatable relative to the fixed stator; and (d) an annular secondary seal seated in the stator bore, the annular secondary seal surrounding a portion of the driveshaft extended out of the housing or a portion of the rotor, the annular secondary seal being fixed relative to the stator or relative to the rotor/driveshaft but not fixed relative to both the stator and the rotor/driveshaft, wherein the annular secondary seal provides a seal between the stator and the rotor or driveshaft while allowing rotation of the driveshaft and rotor relative to the stator.

2. The telemetry tool of claim 1, wherein an internal surface of the stator comprises an annular shoulder against which the secondary seal abuts.

3. The telemetry tool of claim 1 further comprising a retainer configured to retain the secondary seal within the stator bore.

4. The telemetry tool of claim 3 wherein the retainer releasably retains the secondary seal within the stator bore.

5. The telemetry tool of claim 1, wherein the secondary seal is a wiper seal.

6. The telemetry tool of claim 5, wherein the wiper seal is a comb wiper seal.

7. The telemetry tool of claim 1, wherein the rotor comprises a rotor body fixedly attached to the driveshaft and at least a portion of the rotor body is received within the stator bore.

8. The telemetry tool of claim 7, wherein the secondary seal surrounds and seals against the rotor body.

9. The telemetry tool of claim 7, wherein the secondary seal surrounds and seals against the driveshaft.

10. The telemetry tool of claim 7, wherein there is a fluid flow channel between adjacent longitudinal surfaces of the rotor body and the stator and the fluid flow channel defines at least a portion of a tortuous flow path for drilling fluid which flows from external the fluid pressure pulse generator, past the secondary seal to the primary seal when the telemetry tool is positioned downhole.

11. The telemetry tool of claim 10, wherein the tortuous flow path includes at least one change in direction.

12. The telemetry tool of claim 10, wherein the tortuous flow path comprises at least one restricted point and at least one expansion zone, whereby the cross sectional area of the restricted point is less than the cross sectional area of the expansion zone.

13. The telemetry tool of claim 10, wherein an entrance to the fluid flow channel is downhole relative to the primary seal.

14. The telemetry tool of claim 10, wherein an entrance to the fluid flow channel is uphole relative to the primary seal.

15. The telemetry tool of claim 7, wherein the stator comprises a stator body with the stator bore therethrough and a plurality of radially extending stator projections spaced around the stator body whereby spaced stator projections define stator flow channels therebetween, and a plurality of radially extending rotor projections are spaced around the rotor body, and wherein the stator projections are positioned between the rotor projections and the housing, and the rotor projections are axially adjacent and rotatable relative to the stator projections such that the rotor projections move in and out of fluid communication with the stator flow channels to create fluid pressure pulses in drilling fluid flowing through the stator flow channels.

16. A telemetry tool comprising:

(a) a pulser assembly comprising a housing and a driveshaft extending out of an opening in the housing;

(b) a primary seal surrounding and sealing against the driveshaft to seal the opening in the housing;

(c) a fluid pressure pulse generator comprising a stator with a bore therethrough configured to fixedly attach to the housing or to a drill collar surrounding the fluid pressure pulse generator, and a rotor fixedly attached to the driveshaft, wherein the driveshaft and rotor are rotatable relative to the fixed stator and wherein the rotor comprises a rotor body fixedly attached to the driveshaft and at least a portion of the rotor body is received within the stator bore; and (d) a secondary seal seated in the stator bore, the secondary seal surrounding and sealing against a portion of the driveshaft extended out of the housing or a portion of the rotor, wherein there is a fluid flow channel between adjacent longitudinal surfaces of the rotor body and the stator and the fluid flow channel defines at least a portion of a tortuous flow path for drilling fluid which flows from external the fluid pressure pulse generator, past the secondary seal to the primary seal when the telemetry tool is positioned downhole.

17. The telemetry tool of claim 16, wherein the tortuous flow path includes at least one change in direction.

18. The telemetry tool of claim 16, wherein the tortuous flow path comprises at least one restricted point and at least one expansion zone, whereby the cross sectional area of the restricted point is less than the cross sectional area of the expansion zone.

19. The telemetry tool of claim 16, wherein an entrance to the fluid flow channel is downhole relative to the primary seal.

20. The telemetry tool of claim 16, wherein an entrance to the fluid flow channel is uphole relative to the primary seal.

21. A telemetry tool comprising:

(a) a pulser assembly comprising a housing and a driveshaft extending out of an opening in the housing;

(b) a primary seal surrounding and sealing against the driveshaft to seal the opening in the housing while allowing rotation of the driveshaft relative to the housing;

(c) a fluid pressure pulse generator comprising a stator with a bore therethrough configured to fixedly attach to the housing or to a drill collar surrounding the fluid pressure pulse generator, and a rotor fixedly attached to the driveshaft, wherein the driveshaft and rotor are rotatable relative to the fixed stator; and (d) an annular secondary seal seated in the stator bore, wherein the annular secondary seal is fixed relative to the stator and surrounds and seals against a portion of the driveshaft extended out of the housing or a portion of the rotor, wherein the annular secondary seal is not fixed relative to the rotor and driveshaft thereby allowing rotation of the driveshaft and rotor relative to the stator and annular secondary seal.

* * * * *